US008322313B2

(12) United States Patent
Yamaoka et al.

(10) Patent No.: US 8,322,313 B2
(45) Date of Patent: Dec. 4, 2012

(54) HOT WATER STORAGE TYPE HOT WATER SUPPLY DEVICE

(75) Inventors: Tamotsu Yamaoka, Nagoya (JP); Masakazu Ando, Nagoya (JP)

(73) Assignee: Rinnai Corporation, Nagoya-shi (JP)

( * ) Notice: Subject to any disclaimer, the term of this patent is extended or adjusted under 35 U.S.C. 154(b) by 946 days.

(21) Appl. No.: 12/396,639

(22) Filed: Mar. 3, 2009

(65) Prior Publication Data

US 2009/0223465 A1 Sep. 10, 2009

(30) Foreign Application Priority Data

Mar. 4, 2008 (JP) ..... 2008-053632

(51) Int. Cl.
*F24H 9/20* (2006.01)

(52) U.S. Cl. ..... 122/14.22; 122/18.1; 122/31.1; 122/406.1; 700/299; 700/300

(58) Field of Classification Search ..... 122/14.1–14.3, 122/20 R, 31.1, 406.1; 236/21 B, 21 R, 22; 237/19; 165/108, 288, 292, 293; 700/202, 700/205, 299, 300
See application file for complete search history.

(56) References Cited

U.S. PATENT DOCUMENTS 5,020,721 A * 6/1991 Horne ..... 236/20 R
5,067,170 A * 11/1991 Nagashima et al. ..... 392/461
5,203,500 A * 4/1993 Horne, Sr. ..... 237/19
5,956,462 A * 9/1999 Langford ..... 392/449
6,055,944 A * 5/2000 Santiago ..... 122/14.22
6,363,218 B1 * 3/2002 Lowenstein et al. ..... 392/498
7,597,066 B2 * 10/2009 Shimada et al. ..... 122/18.1
2007/0034169 A1 * 2/2007 Phillips ..... 122/14.1
2007/0056956 A1 * 3/2007 Maddox ..... 219/481
2008/0216770 A1 * 9/2008 Humphrey et al. ..... 122/13.3

FOREIGN PATENT DOCUMENTS

JP 61-213437 9/1986

* cited by examiner

*Primary Examiner* — John K Fristoe, Jr.
*Assistant Examiner* — Matthew W Jellett
(74) *Attorney, Agent, or Firm* — Rankin, Hill & Clark LLP

(57) ABSTRACT

A hot water storage type hot water supply device is capable of heating water inside a hot water storage tank appropriately, thereby preventing energy waste. A circulating pump is operated and a burner is incinerated, when the average of detected temperatures from water temperature detectors falls below a predetermined lower limit temperature. The burner is extinguished when an accumulated heating amount from the beginning of operation of a heat source equipment becomes equal to or more than a target heating amount necessary for elevating the total amount of water in the hot water storage tank to a preset hot water delivery temperature. The circulating pump is continuously operated after extinguishing the burner, until an accumulated circulated water amount of a circulating path becomes equal to or more than a predetermined water amount set to be equal to or more than a capacity of the hot water storage tank.

3 Claims, 2 Drawing Sheets

HOT WATER STORAGE TYPE HOT WATER SUPPLY DEVICE

BACKGROUND OF THE INVENTION

1. Field of the Invention

The present invention relates to a hot water storage type hot water supply device equipped with a hot water storage tank connected with a water input pipe and a hot water delivery pipe, and a heat source equipment including a heat exchanger connected to the hot water storage tank via a circulating path and a burner for heating the heat exchanger, in which the water at the lower portion of the hot water storage tank is returned to the upper portion of the hot water storage tank via the heat exchanger by operation of a circulating pump provided at the circulating path.

2. Description of the Related Art

Conventionally, in this type of hot water storage type hot water supply device, there is provided a water temperature detector for detecting the water temperature of the lower portion of the hot water storage tank, and operation of a heat source equipment is carried out in accordance with the temperature detected by the water temperature detector. That is, when the detected temperature of the water temperature detector falls below a preset hot water delivery temperature, the circulating pump is operated as well as the burner of the heat source equipment is ignited, so as to heat the water inside the hot water storage tank by the heat exchanger and circulate the same. Then, when the detected temperature of the water temperature detector elevates to the preset hot water delivery temperature, the burner is extinguished as well as the circulating pump is stopped (refer to, for example, Japanese Patent Publication No. H03-8457 (patent document 1)).

During operation of the heat source equipment, the incinerating amount of the burner is controlled so that the temperature at the outlet of the heat exchanger becomes the preset hot water delivery temperature. However, the temperature of the water flowing into the heat exchanger gradually elevates during operation of the heat source equipment, so that even though the incinerating amount of burner is decreased to its minimal possible incineration, there is a case where the hot water temperature at the outlet of the heat exchanger becomes equal to or above the preset hot water delivery temperature, and that hot water of a high temperature is supplied to the upper portion of the hot water storage tank. And, if the water temperature at the lower portion of the hot water storage tank becomes higher than the preset hot water delivery temperature, the water temperature at the upper portion of the hot water storage tank becomes considerably higher than the preset hot water delivery temperature, resulting in waste of energy.

If the capacity of the circulating pump is upgraded, it is possible to prevent the case where the water temperature at the outlet of the heat exchanger become equal to or more than the preset hot water delivery temperature, by increasing the circulating water amount when the temperature of the water flowing into the heat exchanger elevates. However, this result in inconveniences such as the increase in size and the increase in cost of the circulating pump.

SUMMARY OF THE INVENTION

In view of above, an object of the present invention is to provide a hot water storage type hot water supply device enabling appropriate heating of the water inside the hot water storage tank without excess or deficiency, so as to prevent energy waste, without the need of having to adopt a high capacity pump as the circulating pump.

The present invention has been made in view of the above object, and provides a hot water storage type hot water supply device equipped with a hot water storage tank connected with a water input pipe and a hot water delivery pipe, and a heat source equipment including a heat exchanger connected to the hot water storage tank via a circulating path and a burner for heating the heat exchanger, in which the water at the lower portion of the hot water storage tank is returned to the upper portion of the hot water storage tank via the heat exchanger by operation of a circulating pump provided at the circulating path, the device comprising: a plurality of water temperature detectors for detecting water temperature of the hot water storage tank at a plurality of locations differing in height; a circulated water amount detector for detecting the circulated water amount of the circulating path; and a controller; wherein the controller comprises: a first means for operating the circulating pump as well as igniting the burner, at the beginning of operation of the heat source equipment set as the point in time in which an average water temperature of the hot water storage tank calculated from detected temperatures from the plurality of water temperature detectors falls below a predetermined lower limit temperature set to be lower than a preset hot water delivery temperature; a second means for extinguishing the burner when an accumulated heating amount at the heat exchanger from the beginning of operation of the heat source equipment becomes equal to or more than a target heating amount, the target heating amount being calculated as a heat amount necessary for elevating a total amount of water inside the hot water storage tank to the preset hot water delivery temperature; and a third means for continuously operating the circulating pump after extinguishment of the burner, until an accumulated circulated water amount detected by the circulated water amount detector from the beginning of operation of the heat source equipment is equal to or more than a predetermined water amount set to be equal to or more than a volume of the hot water storage tank.

According to the present invention, the burner is extinguished when the accumulated heating amount at the heat exchanger from the beginning of operation of the heat source equipment reaches the necessary heating amount for elevating the total amount of water inside the hot water storage tank to the preset hot water delivery temperature. Thereafter, the circulating pump is continuously operated until the accumulated circulated water amount from the beginning of operation of the heat source equipment reaches the predetermined water amount set to be equal to or more than the volume of the hot water storage tank. That is, the circulating pump is continuously operated until the total amount of water inside the hot water storage tank is circulated more than once via the circulating path. By doing so, the temperature inside the tank is made uniform, and the water temperature from the upper portion to the lower portion of the hot water storage tank becomes the temperature close to the preset hot water delivery temperature. Therefore, the water inside the hot water storage tank may be heated appropriately without any excess or deficiency, so that energy waste can be prevented.

Further, even in the case where the hot water temperature at the outlet of the heat exchanger becomes higher than the preset hot water delivery temperature during combustion of the burner, the temperature inside the tank is made uniform by the continuous operation of the circulating pump. Therefore, there is no need to adopt high capacity pump as the circulating pump in order to suppress the hot water temperature at the outlet of the heat exchanger becoming higher than the preset hot water delivery temperature, so that reduction in cost can be accomplished.

The heat amount necessary for elevating the total amount of water inside the hot water storage tank to the preset hot water delivery temperature (a target heating amount) is, basically, a heat amount obtained by multiplying the volume of the hot water storage tank and the temperature difference between the preset hot water delivery temperature and the average water temperature of the hot water storage tank at the beginning of operation of the heat source equipment (a reference heat amount). However, when the hot water is delivered from the hot water storage tank via the hot water delivery pipe, water in the equivalent amount to the delivered amount of hot water is input to the hot water storage tank via the water input pipe. Therefore, the total heat amount of the water inside the hot water storage tank decreases by the deviation between the heat amount obtained by multiplying the delivered hot water amount (which is equal to the input water amount) with the delivered hot water temperature from the hot water storage tank (a delivered hot water heat amount) and the heat amount obtained by multiplying the input water amount with the input water temperature to the hot water storage tank (an input water heat amount). That is, the total heat amount of water inside the hot water storage tank is decreased by the heat amount obtained by multiplying the input water amount and the temperature difference between the delivered hot water temperature from the hot water storage tank and the input water temperature to the storage tank. Therefore, if the burner is extinguished when the accumulated heating amount from the beginning of operation of the heat source equipment reaches the reference heat amount, the total amount of water inside the hot water storage tank may not be elevated to the preset hot water delivery temperature in the case where hot water is delivered from the hot water storage tank during combustion of the burner, because the heating amount falls short by the deviation between the delivered hot water heat amount and the input water heat amount.

Therefore, in the present invention, it is preferable to provide an input water amount detector for detecting an input water amount to the hot water storage tank, accumulate from the beginning of operation of the heat source equipment a heat amount obtained by multiplying the input water amount detected by the input water amount detector by a temperature difference between a hot water temperature delivered from the hot water storage tank and a water temperature input to the hot water storage tank, and calculate the target heating amount by adding the accumulated heat amount with the reference heat amount. By doing so, the total amount of water inside the hot water storage tank including the water input during combustion of the burner may be elevated to the preset hot water delivery temperature.

When the target heating amount is calculated this way, the accumulated circulated water amount from the beginning of operation of the heat source equipment may become equal to or more than the capacity of the hot water storage tank at the time of extinguishing the burner, in the case where hot water is delivered during combustion of the burner so that the combustion period of the burner is prolonged. In this case, if the above-mentioned predetermined water amount is set to be the water amount obtained by adding the capacity of the hot water storage tank and the accumulated input water amount detected by the input water amount detector from the beginning of operation of the heat source equipment, the circulating pump is continuously operated even after the burner is extinguished, so that the temperature inside the tank can be made uniform.

DESCRIPTION OF THE PREFERRED EMBODIMENT

Figure 1:
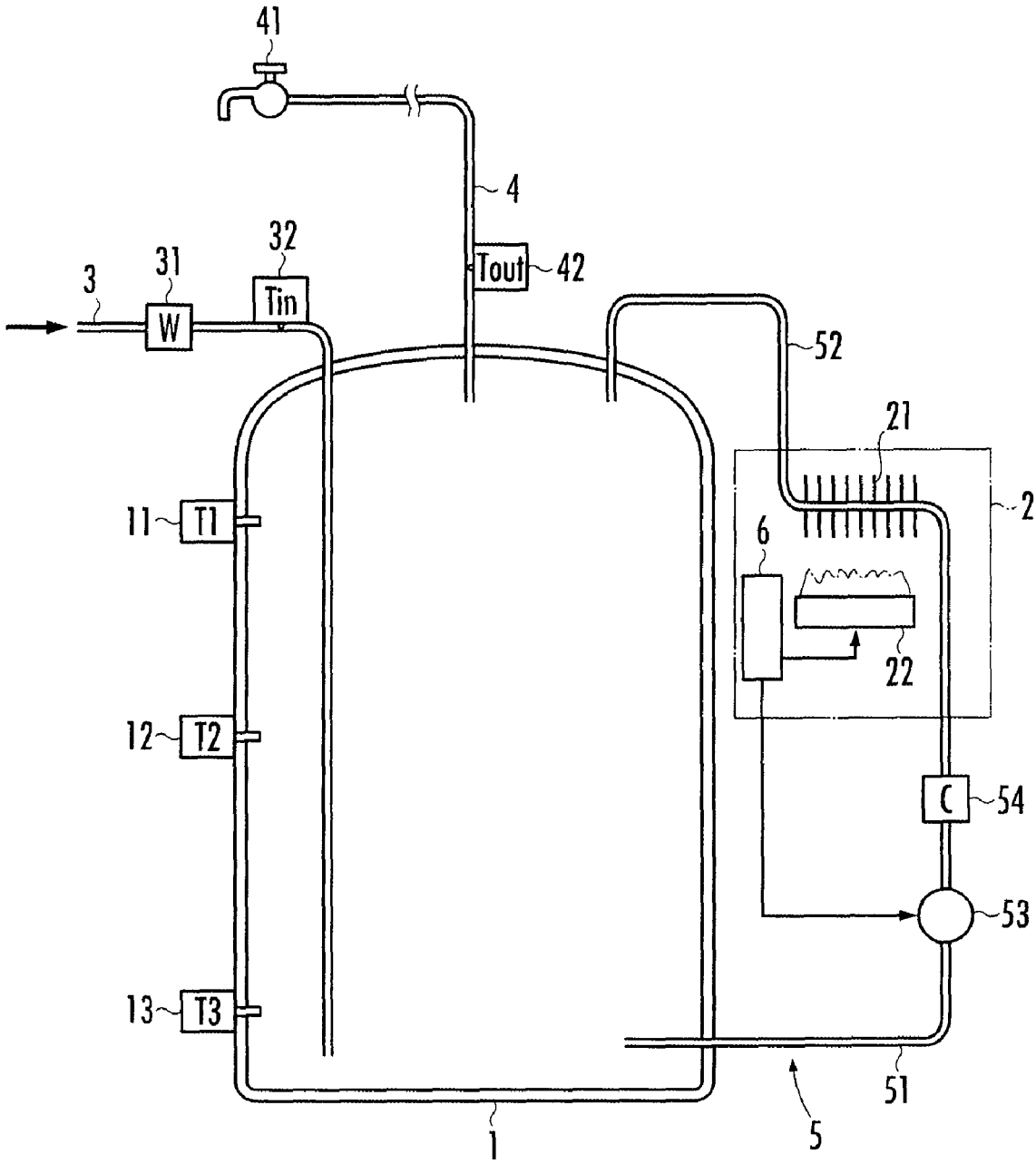
FIG. 1 is an overall configuration drawing of a hot water storage type hot water supply device of the embodiment of the present invention.

With reference to FIG. 1, numeral 1 denotes a hot water storage tank, and numeral 2 denotes a heat source equipment. To the hot water storage tank 1, there are connected a water input pipe 3 for inputting water provided from a water pipe (not shown) via a pressure reducing valve (not shown) to the lower portion of the hot water storage tank 1, and a hot water delivery pipe 4 connected to the upper portion of the hot water storage tank 1. A hot water delivery tap 41 is provided at the downstream side of the hot water delivery pipe 4. When the hot water delivery tap 41 is opened, hot water at the upper portion of the hot water storage tank 1 is delivered via the hot water delivery pipe 4, by the feed-water pressure acting to the inside of the hot water storage tank 1 via the water input pipe 3. Thereafter, water in the equivalent amount to the amount of delivered hot water is input from the water input pipe 3 to the hot water storage tank 1.

The heat source equipment 2 includes a heat exchanger 21 connected to the hot water storage tank 1 via a circulating path 5, and a burner 22 for heating the heat exchanger 21. The circulating path 5 is comprised of an outward path 51 for connecting the lower portion of the hot water storage tank 1 and the inlet of the heat exchanger 21, and a return path 52 for connecting the outlet of the heat exchanger 21 and the upper portion of the hot water storage tank 1. A circulating pump 53 is provided in the outward path 51. By operating the circulating pump 53, the water in the lower portion of the hot water storage tank 1 is returned to the upper portion of the hot water storage tank 1 via the heat exchanger 21.

The hot water storage tank 1 is further provided with three water temperature detectors 11, 12, and 13 for detecting water temperature of the hot water storage tank 1. Each of the water temperature detectors 11, 12, and 13 is provided to a plurality of locations differing in height, and detect the water temperature of the hot water storage tank 1 at, for example, three locations in the vertical direction. To the water input pipe 3, there are provided an input water amount detector 31 for detecting an input water amount W to the hot water storage tank 1, and an input water temperature detector 32 for detecting a water temperature of the water input pipe 3, that is, an input water temperature Tin to the hot water storage tank 1. Further, to the hot water delivery pipe 4, there is provided a delivered hot water temperature detector 42 for detecting a delivered hot water temperature Tout from the hot water storage tank 1 as a water temperature of the hot water delivery pipe 4. Still further, to the circulating path 5, there is provided a circulated water amount detector 54 for detecting a circulated water amount C of the circulating path 5. The detected signals from the detectors are input to a controller 6 comprised of a microcomputer provided in the heat source equipment 2. The controller 6 controls the burner 22 and the circulating pump 53 on the basis of the detected signals (the controller 6 comprises a first means, a second means, and a third means of the present invention).

Figure 2:
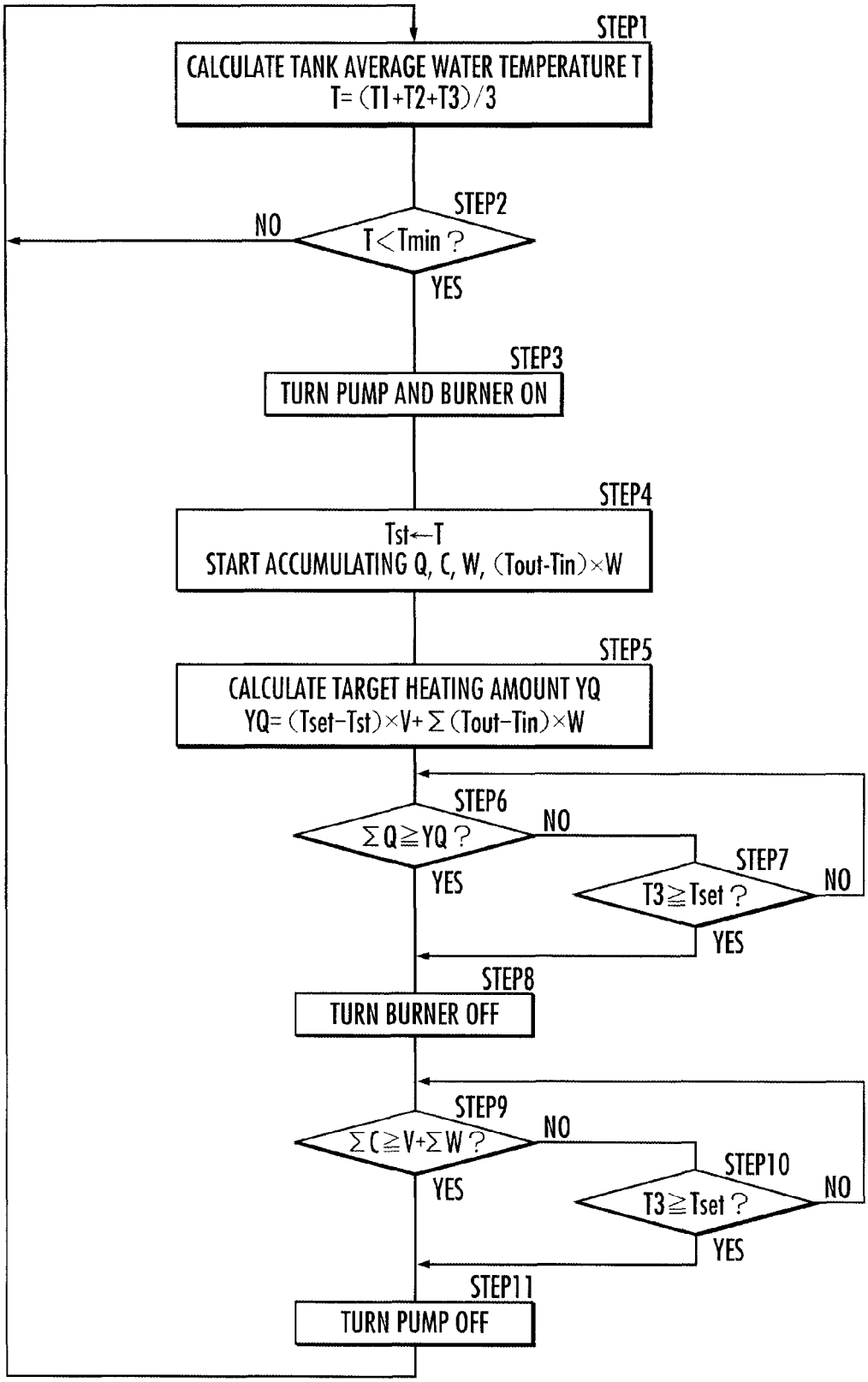
FIG. 2 is a flow chart showing the content of a control performed by a controller of the hot water storage type hot water supply device of the present embodiment.

Next, the control performed by the controller 6 will be explained with reference to FIG. 2. First, in STEP 1, the controller 6 takes an average of a detected temperature T1 of the uppermost first water temperature detector 11, a detected temperature T2 of the intermediate second water temperature detector 12, and a detected temperature T3 of the lowermost third water temperature detector 13 of the hot water storage tank 1, and calculates an average water temperature T of the hot water storage tank 1 (T=(T1+T2+T3)/3). Next, in STEP 2, the controller 6 determines whether the average water temperature T has become lower than a predetermined lower limit temperature Tmin set lower than a preset hot water delivery temperature Tset. Here, the preset hot water delivery temperature Tset is switchable between, for example, three levels of 50° C., 55° C., and 60° C., and the lower limit temperature Tmin is set to be lower than, for example, 20° C., from Tset.

In the case where T≧Tmin, the process returns to STEP 1. In the case where T<Tmin, the controller 6 starts operation of the heat source equipment 2, so as to operate the circulating pump 53 as well as ignite the burner 22 in STEP 3. Then, in STEP 4, the controller 6 stores the average water temperature T at the beginning of operation of the heat source equipment 2 as an initial average water temperature Tst, and starts accumulation of a heating amount Q of the water at the heat exchanger 21 obtained from the combustion amount of the burner 22, accumulation of a circulated water amount C detected by the circulated water amount detector 54, accumulation of an input water amount W detected by the input water amount detector 31, and accumulation of a heat amount obtained by multiplying the input water amount W with the temperature difference between the hot water delivery temperature Tout detected by the delivered hot water temperature detector 42 and the input water temperature Tin detected by the input water temperature detector 32 (=(Tout−Tin)*W).

Next, a target heating amount YQ is obtained in STEP 5. The target heating amount YQ is obtained by adding a reference heat amount obtained by multiplying a capacity V of the hot water storage tank 1 with the temperature difference between the preset hot water delivery temperature Tset and the initial average water temperature Tst (=(Tset−Tst)*V) with an accumulated value Σ(Tout−Tin)*W of (Tout−Tin)*W from the beginning of operation of the heat source equipment 2.

Here, the heat amount necessary for elevating the total amount of water inside the hot water storage tank 1 to the preset hot water delivery temperature Tset is basically (Tset−Tst)*V. However, when the hot water is delivered from the hot water storage tank 1 via the hot water delivery pipe 4, water of the equivalent amount to the hot water delivery amount is input to the hot water storage tank 1 via the water input pipe 3. Therefore, the total heat amount of the water inside the hot water storage tank 1 decreases by the deviation between the heat amount obtained by multiplying the delivered hot water amount (which is equal to the input water amount) W with the delivered hot water temperature Tout from the hot water storage tank 1 (a delivered hot water heat amount) and the heat amount obtained by multiplying the input water amount W with the input water temperature Tin to the hot water storage tank 1 (an input water heat amount), that is, (Tout−Tin)*W. Therefore, if the burner 22 is extinguished when an accumulated heating amount ΣQ from the beginning of operation of the heat source equipment 2 reaches (Tset−Tst)*V, the total amount of water inside the hot water storage tank 1 may not be elevated to the preset hot water delivery temperature Tset in the case where the hot water is delivered from the hot water storage tank 1 after the beginning of operation of the heat source equipment 2, because the heating amount falls short by the accumulated value of the above-mentioned deviation from the beginning of operation of the heat source equipment 2, that is, Σ(Tout−Tin)*W. Therefore, in the present embodiment, the target heating amount YQ is obtained by adding (Tset−Tst)*V with Σ(Tout−Tin)*W.

After obtaining the target heating amount YQ, then it is determined in STEP 6 whether the accumulated heating amount ΣQ from the beginning of operation of the heat source equipment 2 is equal to or more than the target heating amount YQ. If ΣQ≧YQ, then the process proceeds to STEP 8 and the burner 22 is extinguished. If ΣQ<YQ, then it is determined in STEP 7 whether the detected temperature T3 of the third water temperature detector 13 is equal to or more than the preset hot water delivery temperature Tset. If T3≧Tset, then the process proceeds to STEP 8 and the burner 22 is extinguished. If T3<Tset, then the process returns to STEP 6.

After extinguishing the burner 22, the process proceeds to STEP 9 and it is determined whether an accumulated circulated water amount ΣC from the beginning of operation of the heat source equipment 2 is equal to or more than the amount of water obtained by adding the capacity V of the hot water storage tank 1 with an accumulated input water amount ΣW from the beginning of operation of the heat source equipment 2. If ΣC≧V+ΣW, then the process proceeds to STEP 11 to stop the circulating pump 53, and returns to STEP 1. If ΣC<V+ΣW, then the process proceeds to STEP 10 and it is determined whether the detected temperature T3 of the third water temperature detector 13 is equal to or more than the preset hot water delivery temperature Tset. If T3≧Tset, the process proceeds to STEP 11 to stop the circulating pump 53. If T3<Tset, the process returns to STEP 9.

According to the above-mentioned control, the burner 22 is extinguished when the accumulated heating amount ΣQ from the beginning of operation of the heat source equipment 2 reaches the heating amount necessary for elevating the total amount of water inside the hot water storage tank 1, including the water input in response to the hot water delivery after the beginning of operation, to the preset hot water delivery temperature Tset. Then, the circulating pump 53 is continuously operated until the accumulated circulated water amount ΣC from the beginning of operation of the heat source equipment 2 reaches a predetermined water amount set to be more than the capacity V of the hot water storage tank 1. By doing so, the total amount of water inside the hot water storage tank 1 is circulated more than once via the circulating path 5. As such, the temperature inside the tank is made uniform, and the water temperature from the upper portion to the lower portion of the hot water storage tank 1 becomes the temperature close to the preset hot water delivery temperature Tset. Therefore, the water inside the hot water storage tank 1 is heated appropriately without any excess or deficiency, so that energy waste can be prevented. Further, even in the case where the hot water temperature at the outlet of the heat exchanger 21 becomes higher than the preset hot water delivery temperature Tset during combustion of the burner 22, the temperature inside the tank is made uniform by the continuous operation of the circulating pump 53. Therefore, there is no need to adopt high capacity pump as the circulating pump 53 in order to suppress the hot water temperature at the outlet of the heat exchanger 21 from becoming higher than the preset hot water delivery temperature Tset, so that reduction in cost can be accomplished.

If the target heating amount YQ is calculated by adding the reference heat amount (=(Tset−Tst)*V) to the accumulated value of the deviation between the delivered hot water heat amount and the input water heat amount from the beginning of operation of the heat source equipment 2 (=Σ(Tout−Tin)*W), the accumulated circulated water amount ΣC from the beginning of operation of the heat source equipment 2 may become equal to or more than the capacity V of the hot water storage tank 1 at the time of extinguishing the burner 22, in the case where a large amount of hot water is delivered during combustion of the burner 22 so that the combustion period of the burner 22 is prolonged. In the present embodiment, the point in time when the circulated pump 53 is stopped is set to the point in time when the accumulated circulated water amount ΣC from the beginning of operation of the heat source equipment 2 reaches the total sum water amount of the capacity V of the hot water storage tank 1 and the accumulated input water amount ΣW from the beginning of operation of the heat source equipment 2. Therefore, even when a large amount of hot water is delivered during combustion of the burner 22, the circulating pump 53 is made to operate for some time after extinguishment of the burner 22, so that the temperature inside the tank is made uniform.

Further, there is a possibility that abnormality may arise during the calculation of the accumulated heating amount ΣQ, and the determination result in STEP 6 consistently becomes ΣQ<YQ. In the present embodiment, the burner 22 is extinguished when it is determined in STEP 7 that T3≧Tset, so that it is possible to prevent the situation where the burner 22 is continuously combusted due to abnormal calculation of the accumulated heating amount ΣQ.

Similarly, there is a possibility that abnormality may arise during the calculation of the accumulated circulated water amount ΣC or the accumulated input water amount ΣW, and the determination result in STEP 9 consistently becomes ΣC<V+ΣW. In the present embodiment, the circulating pump 53 is stopped when it is determined in STEP 10 that T3≧Tset, so that it is possible to prevent the situation where the circulating pump 53 is continuously operated due to abnormal calculation of the accumulated circulated water amount ΣC or the accumulated input water amount ΣW.

Hereinbefore, the embodiment of the present invention is explained with reference to the attached drawings, but the present invention is not limited thereto. For example, in the present embodiment, the input water temperature Tin and the delivered hot water temperature Tout is detected by providing the input water temperature detector 32 and the delivered hot water temperature detector 42 to the water input pipe 3 and hot water delivery pipe 4, respectively. However, these detectors 32, 42 may be omitted. In such case, the water is input to the lower portion of the hot water storage tank 1 from the water input pipe 3, and hot water is delivered from the upper portion of the hot water storage tank 1 to the hot water delivery pipe 4, so that the detected temperature of the third water temperature detector 13 for detecting the water temperature at the lower portion of the hot water storage tank 1 at the beginning of operation of the heat source equipment 2 is approximate to the input water temperature, and the detected temperature of the first water temperature detector 11 for detecting the water temperature at the upper portion of the hot water storage tank 1 is approximate to the delivered hot water temperature. Therefore, Σ(Tout−Tin)*W may be calculated by taking the detected temperature of the first water temperature detector 11 as the delivered hot water temperature Tout, and taking the detected temperature of the third water temperature detector 13 at the beginning of operation of the heat source equipment 2 as the input water temperature Tin. Further, this may be calculated by taking the preset hot water delivery temperature Tset as the delivered hot water temperature Tout. By doing so, it is possible to omit the input water temperature detector 32 and the delivered hot water temperature detector 42, so that reduction in cost can be accomplished.

What is claimed is:

1. A hot water storage type hot water supply device equipped with a hot water storage tank connected with a water input pipe and a hot water delivery pipe, and a heat source equipment including a heat exchanger connected to the hot water storage tank via a circulating path and a burner for heating the heat exchanger, in which water at a lower portion of the hot water storage tank is returned to an upper portion of the hot water storage tank via the heat exchanger by operation of a circulating pump provided at the circulating path, the device comprising:

a plurality of water temperature detectors for detecting water temperature of the hot water storage tank at a plurality of locations differing in height;

a circulated water amount detector for detecting the circulated water amount of the circulating path; and a controller;

wherein the controller comprises:

a first means for operating the circulating pump as well as igniting the burner, at the beginning of operation of the heat source equipment set as a point in time in which an average water temperature of the hot water storage tank calculated from the detected temperatures from the plurality of water temperature detectors falls below a predetermined lower limit temperature set to be lower than a preset hot water delivery temperature;

a second means for extinguishing the burner when an accumulated heating amount at the heat exchanger from the beginning of operation of the heat source equipment becomes equal to or more than a target heating amount, the target heating amount being calculated as a heat amount necessary for elevating a total amount of water inside the hot water storage tank to the preset hot water delivery temperature; and a third means for continuously operating the circulating pump after extinguishment of the burner, until an accumulated circulated water amount detected by the circulated water amount detector from the beginning of operation of the heat source equipment is equal to or more than a predetermined water amount set to be equal to or more than a volume of the hot water storage tank.

2. The hot water storage type hot water supply device according to claim 1, comprising an input water amount detector for detecting an input water amount to the hot water storage tank, wherein the controller accumulates from the beginning of operation of the heat source equipment a heat amount obtained by multiplying the input water amount detected by the input water amount detector by a temperature difference between a hot water temperature delivered from the hot water storage tank and a water temperature input to the hot water storage tank, and calculates the target heating amount by adding the accumulated heat amount with a reference heat amount obtained by multiplying the volume of the hot water storage tank by a temperature difference between the preset hot water delivery temperature and the average water temperature of the hot water storage tank at the beginning of operation of the heat source equipment.

3. The hot water storage type hot water supply device according to claim 2, wherein the predetermined water amount is set to a water amount which is a sum of the volume of the hot water storage tank and the accumulated input water amount detected by the input water amount detector from the beginning of operation of the heat source equipment.

* * * * *